US007455601B2

(12) United States Patent
Morgan et al.

(10) Patent No.: US 7,455,601 B2
(45) **Date of Patent: *Nov. 25, 2008**

(54) GOLF BALL WITH SPHERICAL POLYGONAL DIMPLES

(75) Inventors: William E. Morgan, Barrington, RI (US); Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 176 days.

This patent is subject to a terminal disclaimer.

(21) Appl. No.: 11/141,093

(22) Filed: May 31, 2005

(65) Prior Publication Data

US 2005/0221916 A1 Oct. 6, 2005

Related U.S. Application Data

(62) Division of application No. 10/077,090, filed on Feb. 15, 2002, now Pat. No. 6,905,426.

(51) Int. Cl.
*A63B 37/14* (2006.01)

(52) U.S. Cl. ..... 473/383

(58) Field of Classification Search ..... 473/378–385
See application file for complete search history.

(56) References Cited

U.S. PATENT DOCUMENTS

| | | | |
|---|---|---|---|
| 1,666,699 | A | 4/1928 | Hagen |
| 2,002,726 | A | 5/1935 | Young |
| 4,090,716 | A | 5/1978 | Martin et al. |
| 4,681,323 | A | 7/1987 | Alaki |
| 4,762,326 | A | 8/1988 | Gobush |
| 4,765,626 | A | 8/1988 | Gobush |
| 4,772,026 | A | 9/1988 | Gobush |
| 4,787,638 | A | 11/1988 | Kobayashi |
| 4,830,378 | A | 5/1989 | Aoyama |
| 4,869,512 | A | 9/1989 | Nomura |
| 4,979,747 | A | 12/1990 | Jonkouski |
| 4,991,852 | A | 2/1991 | Pattison |
| 5,005,838 | A | 4/1991 | Oka |
| 5,158,300 | A | 10/1992 | Aoyama |
| 5,174,578 | A | 12/1992 | Oka et al. |
| 5,338,039 | A | 8/1994 | Oka et al. |
| 5,377,989 | A | 1/1995 | Machin |
| 5,470,076 | A | 11/1995 | Cadorniga |

(Continued)

FOREIGN PATENT DOCUMENTS

| | | | |
|---|---|---|---|
| GB | 2103939 | A | 3/1983 |

(Continued)

*Primary Examiner*—Raeann Trimiew
(74) *Attorney, Agent, or Firm*—Kristin D. Wheeler

(57) ABSTRACT

A golf ball includes an outer spherical surface and a plurality of dimples formed thereon. In accordance to one aspect of the invention, the dimples in accordance to the invention have a polygonal perimeter and a substantially spherical, concave depression. The substantially spherical depression comprises a spherical depression and a transitional portion bridging the area between the polygonal perimeter and the spherical depression. In accordance to another aspect of the invention, one or more sides of the polygonal perimeter may be non-linear or curved. The dimples of the present invention may fill the ball's entire outer surface, or the dimples may occupy a predetermined pattern on the ball. The predetermined pattern may also include one or more channels or raised beads on the surface of the ball.

10 Claims, 9 Drawing Sheets

U.S. PATENT DOCUMENTS

| | | | | |
|---|---|---|---|---|
| 5,503,398 | A | 4/1996 | Lu | |
| 5,536,013 | A | 7/1996 | Pocklington | |
| 5,566,943 | A | 10/1996 | Boehm | |
| 5,601,503 | A | 2/1997 | Yamagishi et al. | |
| 5,735,757 | A | 4/1998 | Moriyama | |
| 5,857,924 | A | 1/1999 | Miyagawa et al. | |
| 5,957,787 | A | 9/1999 | Hwang | |
| 6,059,671 | A | 5/2000 | Asakura | |
| 6,162,136 | A | 12/2000 | Aoyama | |
| 6,176,793 | B1 | 1/2001 | Sullivan et al. | |
| 6,290,615 | B1 | 9/2001 | Ogg | |
| 6,905,426 | B2 * | 6/2005 | Morgan et al. | 473/383 |

FOREIGN PATENT DOCUMENTS

| | | |
|---|---|---|
| JP | 07-289662 | * 11/1995 |
| JP | 07-289662 | 7/1996 |
| JP | 2001-321460 | 11/2001 |
| WO | WO 00/48687 | 2/2000 |

* cited by examiner

GOLF BALL WITH SPHERICAL POLYGONAL DIMPLES

RELATED APPLICATIONS

This application is a divisional application of U.S. application Ser. No. 10/077,090, filed on Feb. 15, 2002 now U.S. Pat. No. 6,905,426.

FIELD OF THE INVENTION

The present invention relates to golf balls, and more particularly, to a golf ball having improved dimples.

BACKGROUND OF THE INVENTION

Golf balls generally include a spherical outer surface with a plurality of dimples formed thereon. Conventional dimples are depressions on the golf balls' surface that reduce drag and increase lift. Drag is the air resistance that opposes the golf ball's flight direction. As the ball travels through the air, the air that surrounds the ball has different velocities thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

In order to optimize ball performance, it is desirable to have a large number of dimples, hence a large amount of dimple circumference, evenly distributed around the ball. In arranging the dimples, an attempt is made to minimize the space between dimples, because such space does not contribute to the aerodynamic performance of the ball. In practical terms, this usually translates into 300 to 500 circular conventional dimples on the surface of a conventional golf ball.

When compared to conventional size dimples, theoretically, an increased number of small dimples will create greater aerodynamic performance by increasing the total dimple circumference. An example of a golf ball with small dimples is discussed in U.S. Pat. No. 4,991,852, which discloses a golf ball having 812 concave hexagonal dimples. However, in reality small dimples are not as effective in decreasing drag and increasing lift. This results at least in part from the susceptibility of small dimples to paint flooding. Paint flooding occurs when the paint coat on the golf ball fills the small dimples, and consequently decreases the dimple's aerodynamic effectiveness. On the other hand, a smaller number of large dimples also begin to lose effectiveness. This results from the circumference of one large dimple being less than that of a group of smaller dimples.

Conventional dimples are typically circular depressions and are formed where a dimple wall slopes away from the outer surface of the ball forming the depression. Typically, these depressions have circular perimeters on the ball surface and have spherical or substantially spherical depressions. It has been demonstrated that dimples comprising spherical or substantially spherical depressions exhibit superior aerodynamic performance than dimples comprising non-spherical depressions. However, the circular perimeters of conventional dimples to a large extent limit the maximum dimple density attainable, due to the irregular shape of the spaces between the circular dimples on the ball surface.

To minimize the spaces between the dimples on the ball surface, polygonal dimples have been proposed. Polygonal dimples have been disclosed in U.S. Pat. Nos. 2,002,726, 6,290,615 B1, 5,338,039, 5,174,578, 4,090,716, 4,869,512, and 4,830,378, among others. None of these references, however, discloses dimples with spherical or substantially spherical depressions. With the exception of the '726 reference, which describes square dimples with a complex concave depression having varying radii, these references disclose polygonal dimples having depressions formed of planar surfaces, i.e., surfaces formed by polygons joined along vertices. It has also been demonstrated that dimples with polyhedron depressions do not perform as well aerodynamically as dimples with spherical or substantially spherical depressions.

Hence, there remains a need in the art for a golf ball that exhibits superior aerodynamic performance and maximum dimple density.

SUMMARY OF THE INVENTION

Accordingly, the present invention is directed to a golf ball with improved dimples.

The present invention is also directed to a golf ball with improved aerodynamic characteristics.

The present invention includes a golf ball comprising a spherical outer surface and a plurality of dimples formed thereon. The dimple perimeter comprises at least one linear edge and each dimple forms a concave, substantially spherical depression. Preferably, a portion of each depression is spherical.

In another aspect of the invention, the dimple perimeter comprises a regular polygon or an irregular polygon. The perimeter may be a triangle, square, rectangle, pentagon, hexagon, heptagon, octagon or any polygon containing at least three sides. The spherical portion of each depression is preferably defined by a curved enclosure contained within the polygonal perimeter. The curved enclosure may contact all the sides of the polygonal perimeter, or may contact one or more sides of the polygonal perimeter. More preferably, the curved enclosure is circular, oval or substantially circular.

Preferably, a transitional surface connects the spherical portion of each depression to the polygonal perimeter of the dimples. The transitional surface may be a substantially flat surface or a curved surface, such as conical, cylindrical, spherical, parabolic or other shapes. The transition surface preferably blends the curvature of the spherical portion of each depression to the lip of the polygonal perimeter. The transitional surface also provides a sloped transition from the outer surface of the ball to the spherical portion of the depression.

The dimple perimeter and the dimple depression may be radially symmetric, i.e., the center of the perimeter and the center of the depression are proximate to each other. These two centers may also coincide to each other. Alternatively, the dimple perimeter and the dimple depression may be radially asymmetric, i.e., the center of the perimeter and the center of the spherical portion are offset from each other.

In another aspect of the invention, the dimple perimeter comprises at least two linear edges. The dimple perimeter may further comprise at least one curved edge. In this embodiment, the spherical portion of the depression is preferably defined by a curved enclosure containing within the dimples' perimeter. More preferably, the curved enclosure is circular, oval, or substantially circular. The curved enclosure may contact one or more sides of the dimple perimeter.

In another aspect of the invention, the dimples are arranged in a predetermined pattern on the golf ball, and conventional dimples may be arranged in the remaining spaces on the golf ball. The predetermined pattern may be a geodesic pattern, a polyhedron pattern or random pattern. Polyhedron pattern includes tetrahedron, octahedron, hexahedron, dodecahedron, and icosahedron, and others. The predetermined pattern may also include an equator or parting line, and lines orthogonal and diagonal thereto. The predetermined pattern may also include longitudinal and/or latitude lines on the ball.

In accordance to another aspect of the invention, dimples having irregular polygonal perimeters are employed. The perimeter may have any number of sides of unequal lengths and the angles between adjacent sides may be acute or obtuse. More particularly, dimples formed of more than one perimeter shape are employed. For example, a portion of a dimple perimeter can be a portion of a triangle and the other portion of the dimple perimeter can be a portion of a hexagon. Moreover, two or more dimple types, including the inventive dimples and conventional dimples, can be employed on a golf ball.

The invention is also directed to a golf ball comprising a substantially spherical outer surface, a plurality of dimples formed on the outer surface of the ball, and a band positioned proximate to an equator of the ball, wherein the elevation of the surface of the band is different than the elevation of the outer surface of the ball. The band can be one or more channels and the surface of the channel(s) is lower than the outer surface of the ball. The band can also be a one or more raised beads and the surface of the raised bead(s) is higher than the outer surface of the ball. The band may have concave or convex features defined thereon, and the ball may have more than one band.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
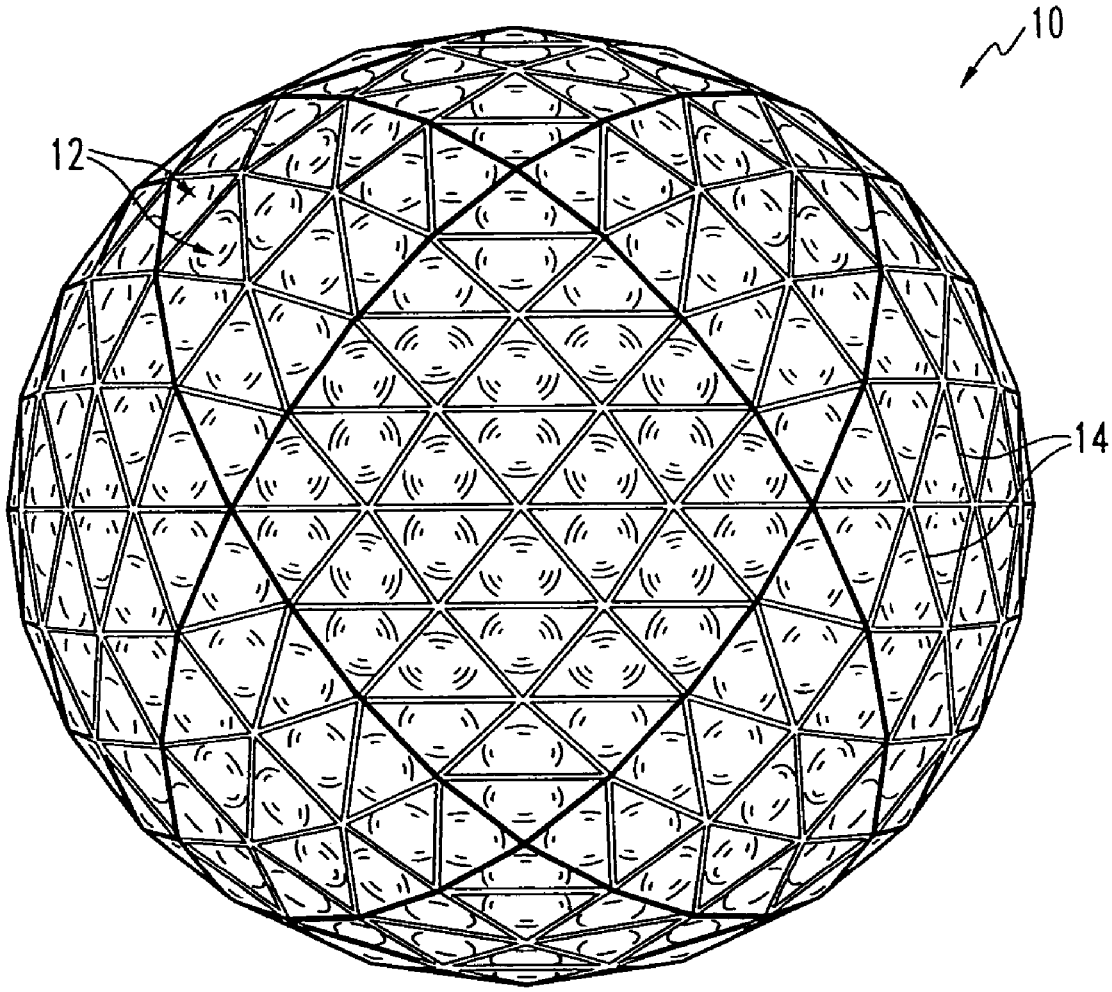
FIG. 1 is a front view of a preferred embodiment of a golf ball having dimples with triangular perimeters and concave, substantially spherical depressions in accordance to the present invention.

As shown generally in FIG. 1 where like numbers designate like parts, reference number 10 broadly designates a golf ball 10 having a plurality of dimples 12 with polygonal perimeter of the present invention separated by outer undimpled or land surfaces 14. Each dimple preferably comprises a polygonal perimeter and a substantially spherical depression 16. The polygonal perimeters of dimples 12 are shown in FIG. 1 as triangular. The present invention, however, is not so limited, and dimples 12 with any regular or irregular polygonal-shaped perimeter with 3 or more sides, and a concave, substantially spherical depression are within the scope of the present invention, as further discussed below. More particularly, dimples formed of more than one perimeter shape are employed. For example, a portion of a dimple perimeter can be a portion of a triangle and the other portion of the dimple perimeter can be a portion of a hexagon. The perimeter may have any number of sides of unequal lengths and the angles between adjacent sides may be acute or obtuse.

Moreover, two or more dimple types, including one or more of the inventive dimples and one or more of conventional dimples, can be employed on a golf ball. Additionally, the sides of the polygonal perimeter are described herein as linear. It is understood that the linear sides appear linear from a top view, but are actually slightly curved to match the curvature of the outer surface 14 of ball 10.

Figure 2A:
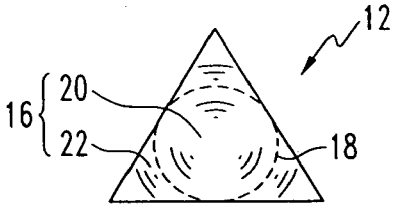
FIGS. 2A-2E are top views of the preferred dimple embodiments in accordance to the present invention.
Figure 2B:
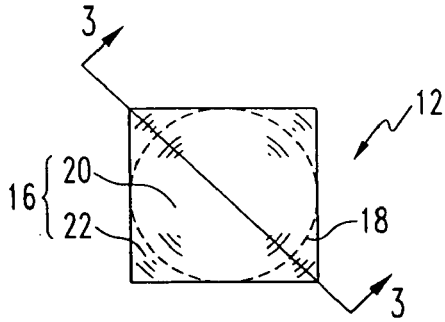
Figure 2C:
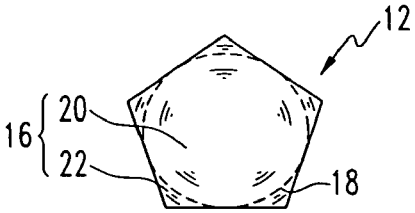
Figure 2D:
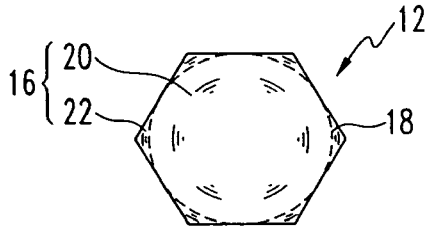
Figure 2E:
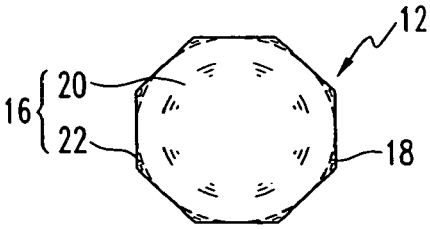

A preferred way of constructing a dimple 12 with a polygonal perimeter and concave, substantially spherical depression is to draw an internal curved enclosure, such as circle 18, within the polygon with each side of the polygon touching the perimeter of the circle, as shown in FIG. 2A-2E. The dimple surface area 20 within the internal circle 18 is concave and preferably comprises a spherical depression. The dimple surface areas 22 between the internal circle 18 and the polygonal perimeter are transitional areas and are preferably sloped toward the spherical depression, and preferably have substantially flat, conical, cylindrical, parabolic or spherical surfaces to blend into the spherical depression 20 at circle 18 to minimize the differences in the curvatures between the transition surface 22 and the spherical depression 20. For polygons with a relatively small number of linear sides, such as triangles, squares, rectangles or other four-sided polygons, where the transitional dimple areas 22 are relatively large, as shown in FIGS. 2A and 2B, conical, cylindrical, parabolic, spherical or other curved transitional areas are preferred. For polygons with a relatively large number of sides, such as pentagons, hexagons, heptagons or octagons, where the transitional areas are relatively small as shown in FIGS. 2C-2E, curved and substantially flat transitional areas are preferred.

Figure 3:
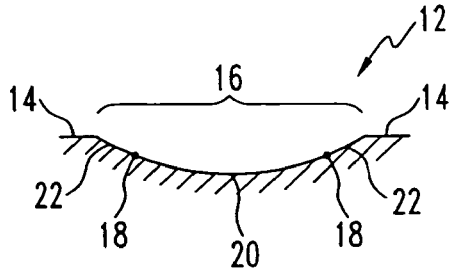
FIG. 3 is a cross-sectional view along line 3-3 in FIG. 2B.
Figure 4:
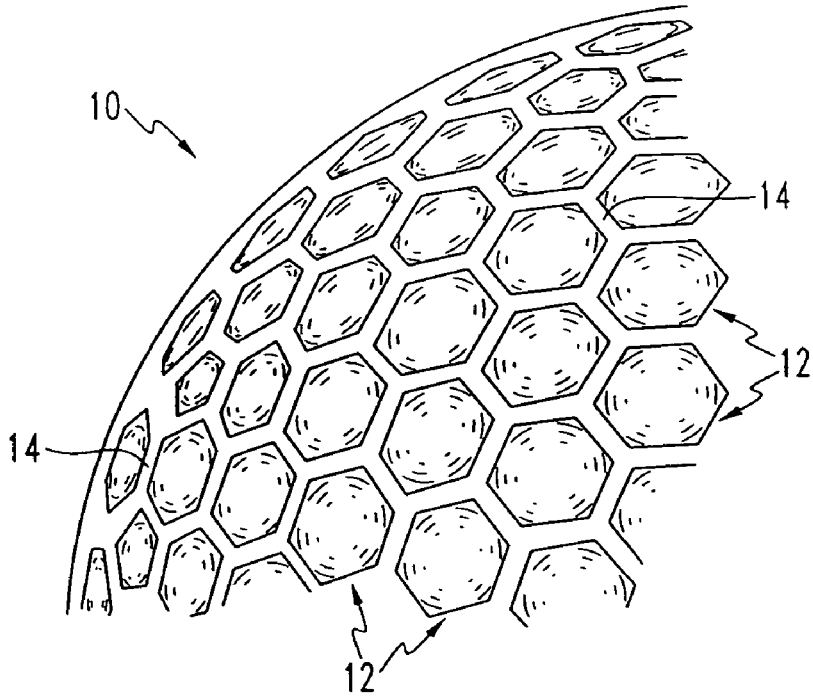
FIG. 4 is a partial view of a golf ball with dimples having hexagonal perimeters and concave, substantially spherical depressions in accordance to the present invention.
Figure 5:
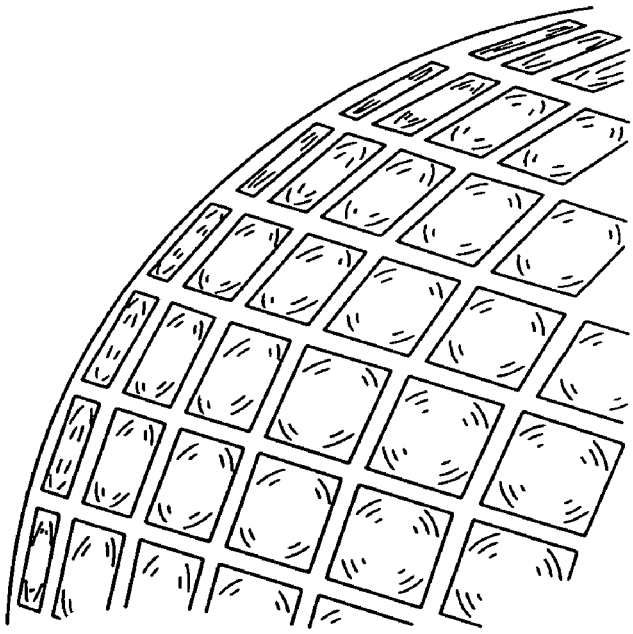
FIG. 5 is a partial view of a golf ball with dimples having square perimeters and concave, substantially spherical depressions in accordance to the present invention.

As shown in the cross-sectional view of FIG. 3, in accordance to one aspect of the present invention the transitional areas 22 merge seamlessly with the spherical depression 20 at circle 18 to form a substantially spherical depression 16 to maximize the aerodynamic advantages of dimples 12. FIGS. 4 and 5 show preferred embodiments of the present invention with dimples having hexagonal and square perimeters and concave, substantially spherical depressions 16. The inner surface of the dimple that defines the spherical depression 20 is formed such that it defines a curved surface that is substantially similar to a portion of a sphere or parabolically curved as, for example, that defined by a catanary curve as set forth in copending U.S. application Ser. No. 09/989,191, which is incorporated by reference herein in its entirety.

Figure 6A:
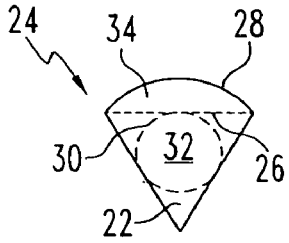
FIGS. 6A-6F are front views of other preferred dimple embodiments of the golf ball dimple in accordance to the present invention.
Figure 6B:
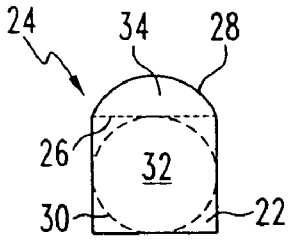
Figure 6C:
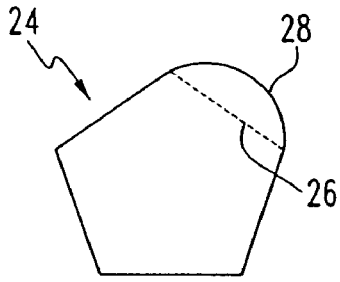
Figure 6D:
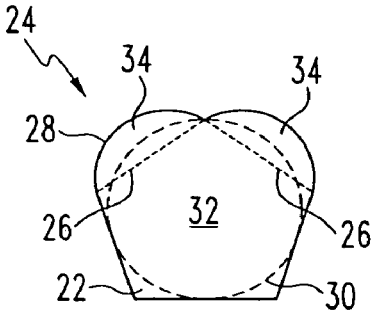
Figure 6E:
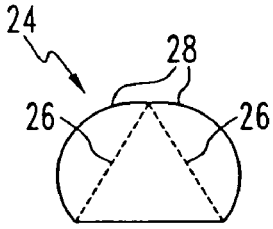
Figure 6F:
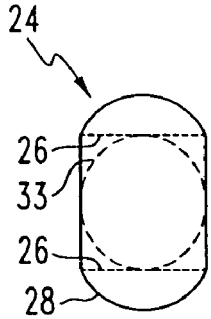

In accordance to another aspect of the invention, the perimeter of the inventive dimple may have one or more linear sides joined to one or more arcuate or circular sides, as illustrated by dimples 24 in FIGS. 6A-6F. Dimples 24 may have one side 26 (shown in phantom) in the polygon replaced by an arcuate side 28, as shown in FIGS. 6A-6C, or may have two or more sides 26 (shown in phantom) replaced by two or more sides 28, as shown in FIGS. 6D-6F. In this embodiment, the internal circle 30, which defines the spherical depression 32, may touch all the sides of the polygonal perimeter and side(s) 26 (shown in phantom), as shown in FIGS. 6A and 6B. The transitional depression 34 between the arcuate side 28 and the internal circle 30 is preferably conical, cylindrical, spherical, parabolic or otherwise curved to closely match the curvature of spherical depression 32. This configuration of internal circle 30 illustrated in FIGS. 6A and 6B is suitable for any dimple 24 of any shape.

Alternatively, internal circle 30 may extend beyond the side(s) 26 (shown in phantom) as shown in FIG. 6D to minimize the surface area of the transitional depression 34. Transitional depression 34 is preferably conical, spherical, cylindrical, parabolic or otherwise curved to match the curvature of spherical depression 32. This configuration of circle 30 illustrated in FIG. 6D is also suitable for any dimple 24 of any perimeter shape. Additionally, the circle 30 may extend into another curve-shaped enclosure to minimize the transitional depression, such as oval 33 shown in FIG. 6F. Alternatively, internal circle 30 of dimple 24 and internal circle 18 of dimple 12 may be contained within the dimple perimeter without contacting the dimple perimeter. The specific embodiments of dimple 24 shown in FIGS. 6A-6F are for illustrative purposes only and do not limit the invention.

In accordance to another aspect of the present invention, land surfaces 14 between the polygonal dimples may be reduced to a series of interconnected line segments of fairly narrow width. Preferably, land surfaces 14 occupy about 5% to 40% of the surface of ball 10. More preferably, land surfaces 14 occupy about 7% to 30% of the surface of ball 10. Most preferably, land surfaces 14 occupy about 10% to 20% of the surface of ball 10. Also preferably, a golf ball would have from about 300 to about 500 inventive dimples on its surface. A denser dimple packing geometry contributed by the polygonal dimple perimeters and the demonstrated superior aerodynamic performance contributed by spherical or substantially spherical depressions combine to give golf ball 10 of the present invention better aerodynamic characteristics than golf balls known in the prior art.

In accordance to another aspect of the invention, some of the dimples on the golf ball are the inventive dimples 12, 24 arranged preferably along parting lines or equatorial lines, in proximity to the poles or along the outlines of a geodesic or polyhedron pattern, and the conventional dimples may occupy the remaining spaces. The reverse arrangement is also suitable. Suitable geodesic patterns include, but are not limited to, tetrahedron, octahedron, hexahedron, dodecahedron, icosahedron among other polyhedrons.

Figure 7:
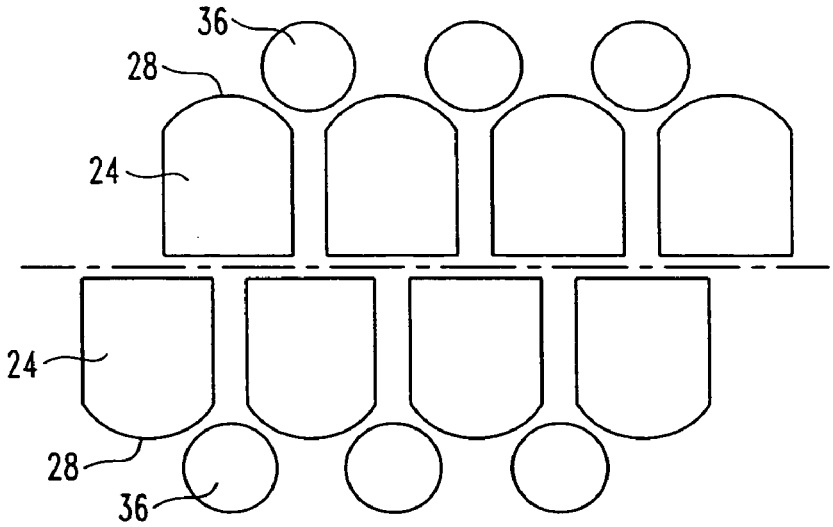
FIG. 7 is a partial top view of a dimple pattern utilizing the dimple shown in FIG. 6B and conventional circular dimples.

A particular pattern of dimples 24 is illustrated in FIG. 7. Here, dimples 24 as shown in FIG.6B are aligned along an imaginary equator or a parting line with linear sides aligned opposite to each other flanking the equator. Alternatively, the linear sides of dimples 24 may also be aligned opposite to each other flanking the channels or raised beads 46 shown in FIGS. 18, 19A and 19B. The curved sides 28 of dimples 24 can be aligned with conventional circular dimples in a tight packing relationship as shown in FIG. 7. Alternatively, curved sides 28 may be aligned in a tight packing relationship with other curved sides 28 of other dimples 24.

In accordance to another aspect of the invention, inventive dimples 12 or 24 have the same perimeter configuration on the surface of golf ball 10. The concave profile of each dimple, however, may have varying depth. The curvature of the transition surfaces 22, 34 may also vary, as well as the angle that the transition surfaces makes with the undimpled or land surfaces 14 or with the spherical depressions 20. Similarly, while the profiles of the dimples may be substantially the same, the dimples on the ball surface may comprise two or more dimples 12, shown in FIGS. 2A-2E, or two or more dimples 24, shown in FIGS. 6A-6F, or a combination of dimples 12 and 24 and conventional dimples. Alternatively, both the concave profiles and the polygonal perimeter configurations of the dimples may vary on a golf ball.

In accordance to another aspect of the invention, the dimples 12 shown in FIGS. 2A-2E and dimples 24 shown in FIGS. 6A and 6B are radially symmetric, i.e., the center or deepest point of the spherical depression 20 coincides with the center of the polygonal perimeter. Similarly, the center or deepest point of the spherical depression 32 of dimple 24 shown in FIG. 6D is located proximate to the center of the perimeter of the dimple 24. Conversely, to provide golf ball designers with more design choices, dimples 12, 24 are radially asymmetric, i.e. the center or deepest point of spherical depression 20, 32 are offset or spaced apart from the center of the polygonal perimeters of the dimple.

In accordance to yet another aspect of the present invention, dimples 12, 24 are arranged symmetrically on the ball. On the other hand, dimples 12, 24 can be arranged asymmetrically. The asymmetric arrangement may follow a predetermined pattern or may be random.

The dimples 12, 24 of the present invention may also be utilized with golf clubs to provide distinctive markings for the club heads, or with other decorative items or clotting items associated with the game of golf.

Figure 8:
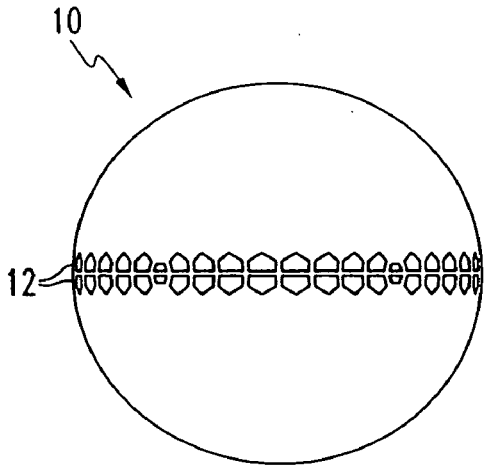
FIGS. 8-11 are front views of preferred partial dimple patterns utilizing the inventive dimples of the present invention.
Figure 9:
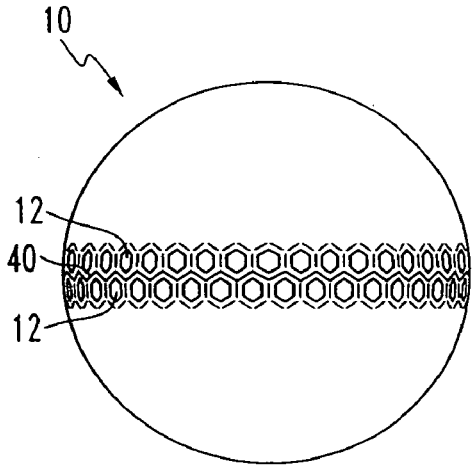
Figure 10:
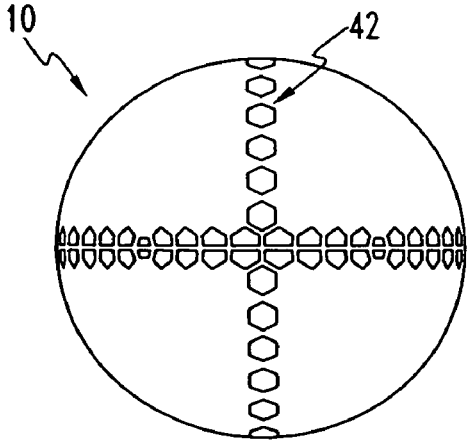
Figure 11:
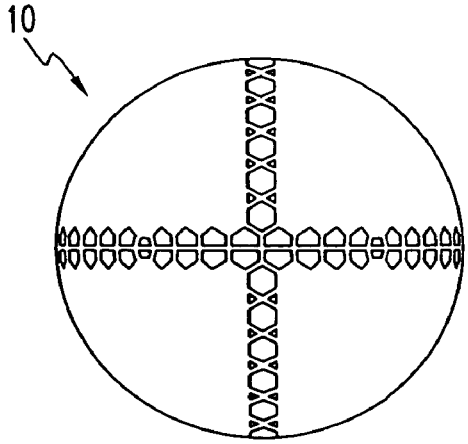

As discussed above in connection with FIG. 7, the polygonal dimples 12, 24 of the present invention may be used to minimize the visual effects of parting lines on the golf ball or to create visual effects on the golf ball. As illustrated in FIG. 8, two rows of irregular polygonal perimeter dimples flank an equator on the golf ball. The equator may also be a parting line on the ball. The visual effects of a parting line may also be minimized with the arrangement shown in FIG. 9, where a non-linear line 40 between two rows of hexagonal perimeter dimples superimposes on top of the equator or parting line. Furthermore, two orthogonal lines of dimples may be aligned on a golf ball as shown in FIG. 10, where a vertical line 42 of hexagonal perimeter dimples 12 is aligned orthogonally to the dimples shown in FIG. 8. Additionally, as shown in FIG. 11, triangular perimeter dimples may be inserted interstitially between vertical line 42 of hexagonal perimeter dimples of FIG. 10, such that other vertical lines of hexagonal perimeter and triangular perimeter dimples, or lines of three-sided or four-sided polygonal perimeter dimples may be positioned adjacent thereto in a tight packing relationship.

Figure 12:
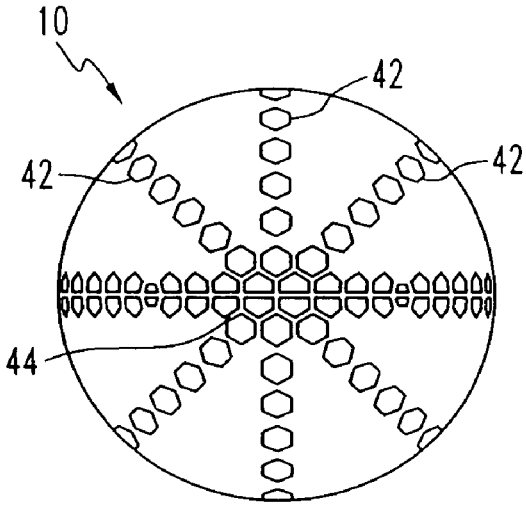
FIGS. 12-14 are front views of additional preferred partial dimple patterns utilizing the inventive dimples of the present invention.
Figure 13:
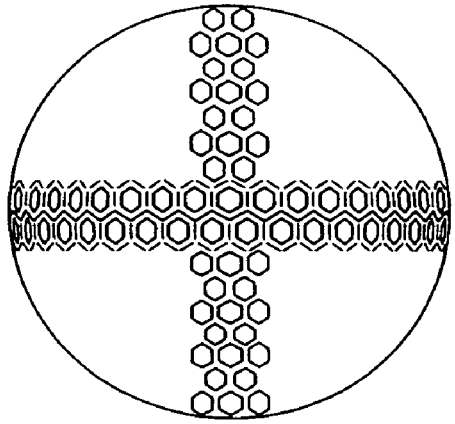
Figure 14:
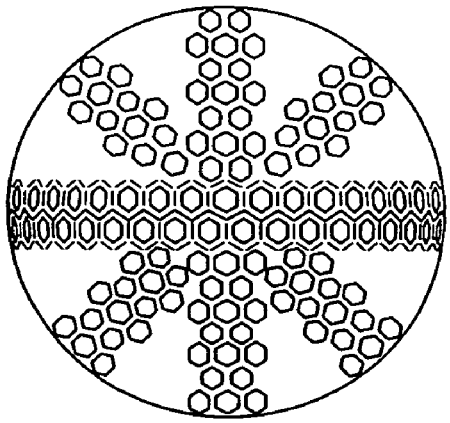
Figure 15:
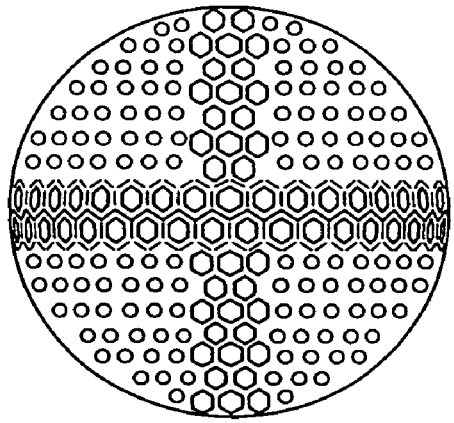
FIG. 15 is a front view of a preferred dimple pattern utilizing a combination of the inventive dimples and conventional spherical dimples.

Additionally, as shown in FIG. 12, the line 42 of hexagonal perimeter dimples is repeated diagonally across the golf ball. Preferably, all the lines of dimples intersect each other at region 44. As shown in FIG. 13 a group of orthogonal lines 42 of polygonal perimeter dimples may be superimposed on the equatorial lines of dimples of FIG. 9. Additional groups of vertical lines 42 may also be arranged diagonally as shown in FIG. 14. Alternatively, the quadrants defined by the polygonal dimples shown in FIG. 13 may be filled with conventional circular dimples or other conventional dimples as illustrated in FIG. 15.

Figure 16:
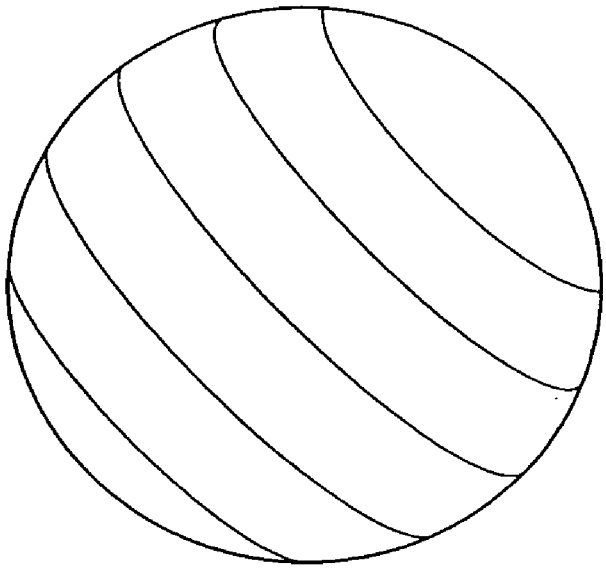
FIGS. 16 and 17 schematically show other preferred dimple patterns utilizing the inventive dimples of the present invention.
Figure 17:
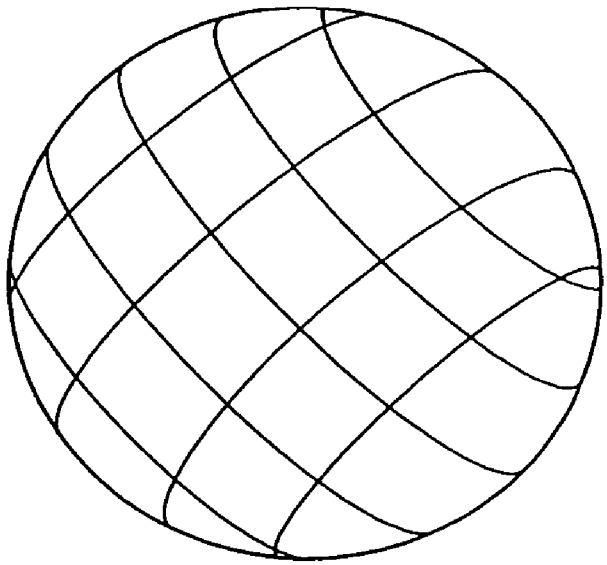

Alternatively, the lines of polygonal perimeter dimples in accordance to the present invention may be arranged along the "longitudes" of the ball, as depicted in FIG. 16, or along both the "longitudes" and "latitudes" of the ball, as depicted in FIG. 17. The remaining spaces can be filled with conventional dimples. The exemplary arrangements of the inventive dimples 12, 24 on a golf ball described and illustrated herein are illustrative only, and the present invention is not limited to any particular arrangement.

Furthermore, the dimple patterns shown in FIGS. 7-17 or any other predetermined patterns may be employed with any types of dimples, including the inventive dimples, the conventional circular dimples and other dimples known in the art. More specifically, suitable dimples also include the regular and irregular polygonal dimples with depressions formed of planar surfaces as illustrated in U.S. Pat. Nos. 6,290,615 B1; 4,830,378; 4,090,716; and 5,338,039, or non-spherical and non-polygonal dimples as illustrated in U.S. Pat. Nos. 5,377,989 and 4,869,512.

Figure 18:
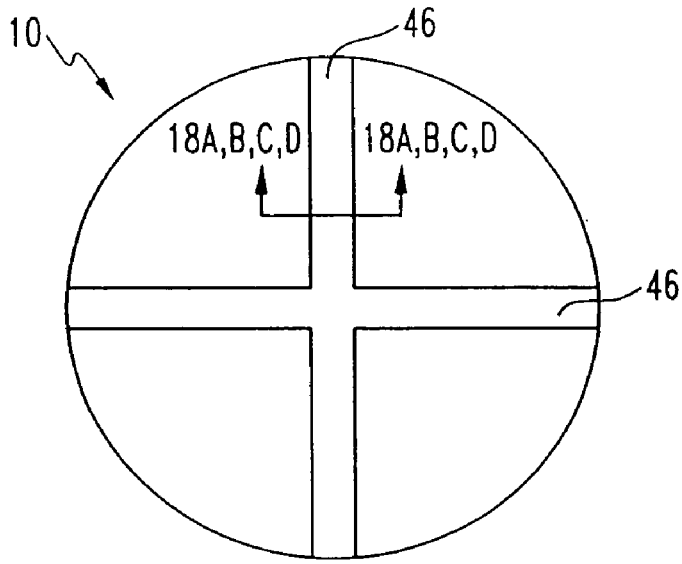
FIG. 18 is a front view of another embodiment of the present invention with certain details omitted for clarity.
Figure 18A:
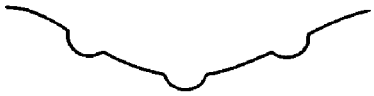
FIGS. 18A-18D are cross-sectional views along line 18A, B, C, D-18A, B, C, D in FIG. 18.
Figure 18B:
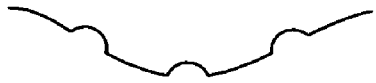
Figure 18C:
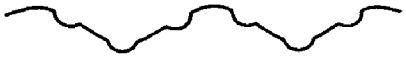
Figure 18D:
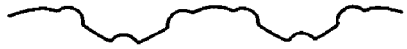

In accordance to another aspect of the invention, as shown in FIG. 18 a relatively shallow channel 46 is disposed on the equator of the ball, and another relatively shallow channel may be arranged orthogonal thereto. In a preferred embodiment, these channels are similar to the grooves on a basketball. Channel 46 may be a single channel and may have concave or convex features defined thereon, as illustrated in FIGS. 18A and 18B, or channel 46 may comprise a double channel with concave and convex features defined thereon, as illustrated in FIGS. 18C and 18D.

Figure 19A:
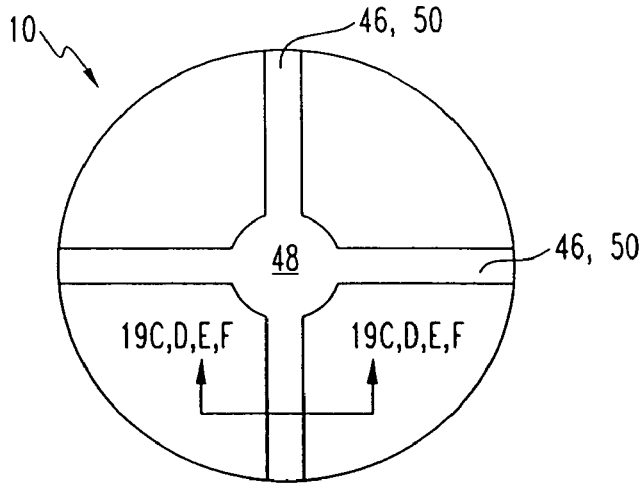
FIGS. 19A and 19B are front views of other embodiments of the present invention with certain details omitted for clarity.
Figure 19B:
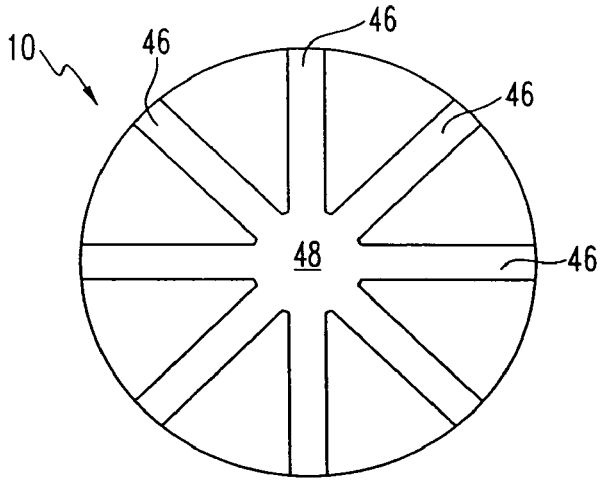
Figure 19C:
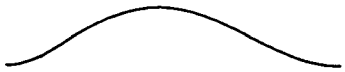
FIGS. 19C-19F are cross-sectional views along the line 19C, D, E, F-19C, D, E, F in FIG. 19A.
Figure 19D:
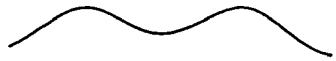
Figure 19E:
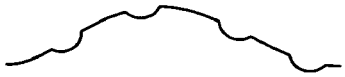
Figure 19F:
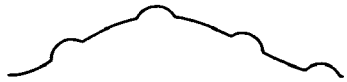

A hub 48 may be provided where the channels 46 intersect, as illustrated in FIG. 19A, and additional channels 46 may be provided diagonally, as illustrated in FIG. 19B. Alternatively, in place of channel 46, a raised bead 50 may be provided. Raised bead 50 protrudes slightly above the surface of the golf ball. Raised bead 50 may be single bead shown in FIG. 19C or a double bead shown in FIG. 19D, and may have concave or convex features defined thereon as depicted in FIGS. 19E and 19F. Preferably, dimples 12, 24 fill the spaces between the channels 46 or raised beads 50. Alternatively, conventional dimples may be used. Also, a golf ball may have both channel(s) 46 and raised bead(s) 50.

In accordance to another aspect of the invention, the polygonal perimeters of dimple 12 may be replaced by isodiametric polygonal perimeters. Isodiametric polygons are described in U.S. Pat. No. 5,377,989, which is incorporated herein by reference. Additionally, the inventive dimples of the present invention may be arranged on the golf ball in accordance to the phyllotaxic methodology. The phyllotaxic methodology is fully described in U.S. Pat. No. 6,338,684. The '684 patent is incorporated by reference in its entirety.

The dimpled golf ball in accordance to the present invention can be manufactured by injection molding, stamping, casting, among other known manufacturing techniques. The molds for making golf balls using the inventive dimples can be made by multi-axis machining, electric machining discharge (EMD) process, chemical etching and hobbing, among others.

While various descriptions of the present invention are described above, it is understood that the various features of the embodiments of the present invention shown herein can be used singly or in combination thereof. This invention is also not to be limited to the specifically preferred embodiments depicted therein.

What is claimed is:

1. A golf ball comprising:

a substantially spherical outer surface, and a plurality of first dimples formed on the outer surface of the ball, wherein the perimeter of the first dimples comprises a regular polygon, and defines a concave, substantially spherical depression surrounded by a transitional area, wherein the transitional area merges seamlessly with the spherical depression, wherein the spherical portion of the depression is defined by a curved enclosure, said curved enclosure is contained within the regular polygonal perimeter, wherein the spherical portion of the depression is defined by a curved enclosure, said curved enclosure contacts all the sides of the regular polygonal perimeter.

2. The golf ball of claim 1, wherein the perimeter is selected from the group consisting of triangle, square, rectangle, pentagon, hexagon, heptagon, and octagon.

3. The golf ball of claim 1, wherein the curved enclosure is a circle.

4. The golf ball of claim 3, wherein the transitional surface area is substantially a flat surface.

5. The golf ball of claim 3, wherein the transitional area is a curved surface.

6. The golf ball of claim 5, wherein the curved surface is spherical.

7. The golf ball of claim 5, wherein the curved surface is parabolic.

8. The golf ball of claim 3, wherein the center of the curved enclosure and the center of the perimeter are located proximate to each other.

9. The golf ball of claim 3, wherein the center of the curved enclosure and the center of the perimeter coincide with each other.

10. The golf ball of claim 3, wherein the center of the curved enclosure and the center of the perimeter are offset from each other.

* * * * *